US007516584B2

(12) United States Patent
Valentine

(10) Patent No.: US 7,516,584 B2
(45) Date of Patent: Apr. 14, 2009

(54) VENTILATING BASEBOARD ATTACHED TO INTERSECTION OF FLOOR AND WALL

(76) Inventor: Jim Louis Valentine, Route 2, P.O. Box 540, Glencoe, OK (US) 74032

( * ) Notice: Subject to any disclaimer, the term of this patent is extended or adjusted under 35 U.S.C. 154(b) by 475 days.

(21) Appl. No.: 11/018,469

(22) Filed: Dec. 21, 2004

(65) Prior Publication Data

US 2006/0130413 A1 Jun. 22, 2006

(51) Int. Cl.
*E04F 19/04* (2006.01)
*E04B 1/70* (2006.01)

(52) U.S. Cl. ..... 52/287.1; 52/302.3

(58) Field of Classification Search ..... 52/287.1, 52/254, 716.1, 290, 302.1, 302.3, 717.01, 52/288.1, 439, 219, 169.5, 716.2; 312/140.4; D25/136

See application file for complete search history.

(56) References Cited

U.S. PATENT DOCUMENTS 1,917,139 A * 7/1933 McCutcheon ..... 52/254
2,039,096 A * 4/1936 Lukens ..... 264/327
2,301,672 A * 11/1942 Akam ..... D25/124
2,705,342 A * 4/1955 Hendry ..... 264/328.1
3,283,460 A * 11/1966 Patrick ..... 52/274
3,473,278 A * 10/1969 Gossen ..... 52/288.1
3,549,474 A * 12/1970 Denton ..... 52/287.1
5,157,886 A 10/1992 Azzar et al.
5,501,044 A * 3/1996 Janesky ..... 52/287.1
6,101,775 A * 8/2000 Larimore ..... 52/302.1
6,186,605 B1 * 2/2001 Nelson ..... 312/140.4
6,354,057 B1 * 3/2002 Ploplis ..... 52/716.1
6,604,331 B1 8/2003 Pallas et al.
6,742,312 B2 6/2004 Valentine
6,792,725 B1 * 9/2004 Rutherford ..... 52/209
7,383,670 B1 * 6/2008 Meyers ..... 156/71

OTHER PUBLICATIONS

"Johnsonite Ventcove" brochure, Revision 3, Released Jan. 1999.

* cited by examiner

*Primary Examiner*—Michael Safavi
(74) *Attorney, Agent, or Firm*—Dunlap Codding, P.C.

(57) ABSTRACT

A baseboard for covering an expansion gap located at an intersection of a vertical wall and a floor. The baseboard is formed of thermoplastic elastomer and has an L-shaped body having a toe portion and a wall portion. The back side of the wall portion has a plurality of spaced-apart ventilation channels extending from the upper end of the wall portion to the lower end thereof. Each ventilation channel has a substantially rectangular shaped cross-section. The back side of the wall portion further includes a plurality of wall contact surfaces extending between each ventilation channel and a plurality of adhesive gripping grooves formed therethrough that function as a catch element when the baseboard is adhesively secured to the wall.

3 Claims, 2 Drawing Sheets

VENTILATING BASEBOARD ATTACHED TO INTERSECTION OF FLOOR AND WALL

BACKGROUND OF THE INVENTION

1. Field of the Invention

The present invention relates generally to a baseboard, and more particularly, but not by way of limitation, to a lightweight baseboard with improved venting for a floor assembly.

2. Brief Description of the Related Art

Certain types of sports floors, such as would be found in a gymnasium, are constructed so that the floor absorbs impact forces. As such, the floors are often made of wood and supported above a concrete slab with a plurality of shock absorbers. The shock absorbers function as spacers thereby creating a space between the floor and the concrete slab. While the space allows the floor to flex and absorb impact forces, the space is also an ideal location for moisture to collect. The moisture may then be absorbed by the wood floor and cause the floor to swell which can affect the performance of the floor and shorten its life. Therefore, it is desirable to provide ventilation to the space between the floor and the concrete slab to eliminate the accumulation of moisture.

Baseboards for covering expansion gaps at the intersection of a vertical wall and a floor are well known. Many baseboards are designed to be adhered to the wall so as not to provide any ventilation between the baseboard and the wall. However, baseboard units have been suggested which have included small, round vents in the backside of the baseboard for air circulation beneath the floor. While such baseboards have been met with success, they nevertheless often provide inadequate ventilation beneath the floor, are expensive to transport, and difficult to handle.

To this end, a need exists for a baseboard that provides adequate ventilation beneath the floor, is contoured to facilitate the application of adhesive thereby preventing excess adhesive from smearing or bleeding onto exposed surfaces of the wall, is mar-resistant and/or mar-masking, and lightweight. It is to such an improved baseboard that the present invention is directed.

DETAILED DESCRIPTION OF THE INVENTION

Figure 1:
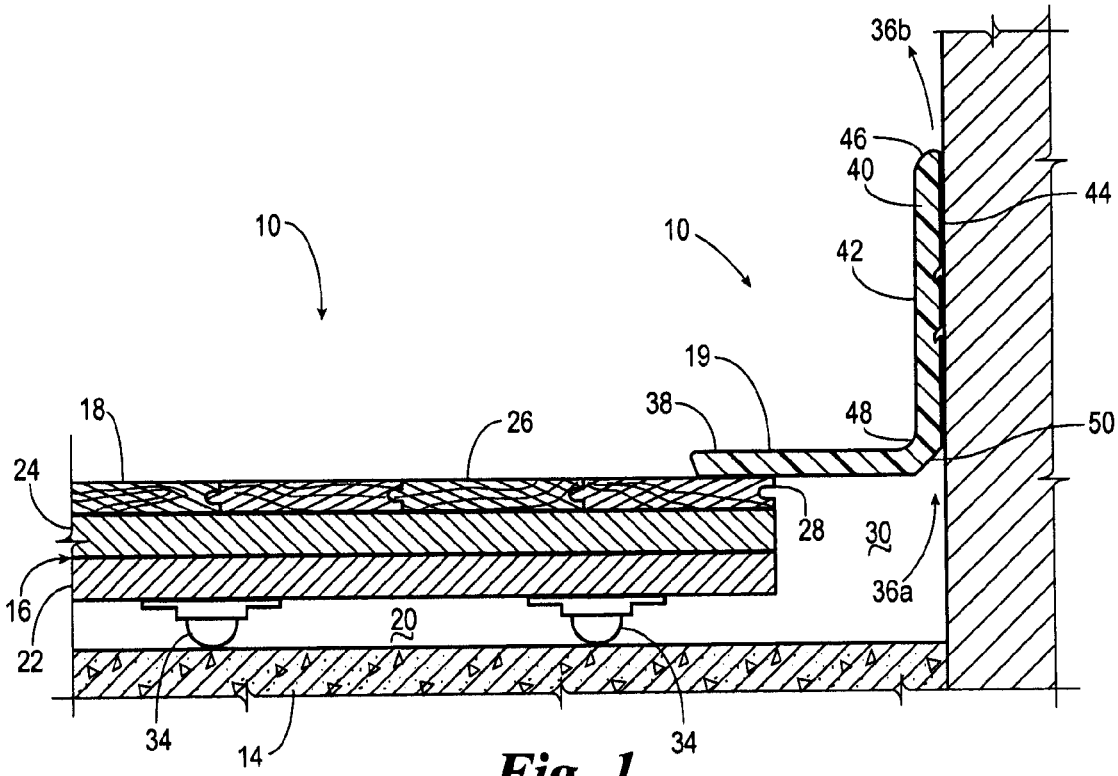
FIG. 1 is a perspective view of a baseboard constructed in accordance with the present invention shown positioned over a portion of a floor and a wall.
Figure 2:
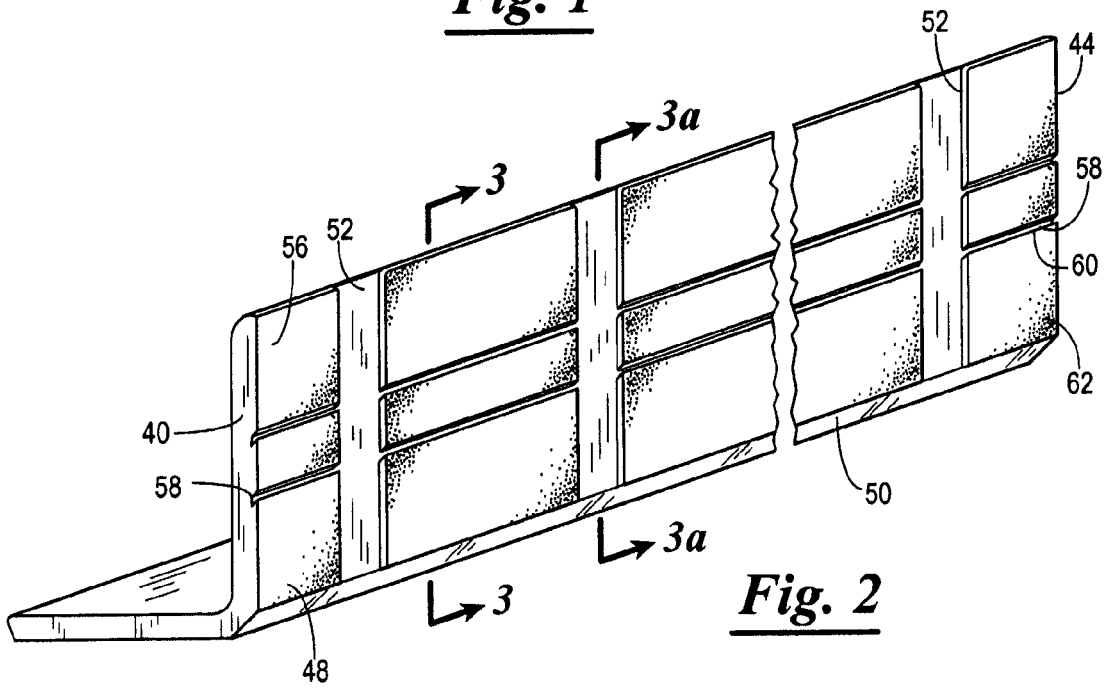
FIG. 2 is a perspective view of the baseboard of the present invention.

Referring now to the drawings, and more particularly to FIGS. 1 and 2, a floor assembly 10 is shown positioned adjacent a vertical wall 12. The floor assembly 10 is the type that would typically be found in, for example, a gymnasium, arena, school, or convention hall. The floor assembly 10 includes a rigid support base 14, a sub-flooring 16, a floor 18, and a baseboard 19. A cement slab is generally provided as the rigid support base 14 for the floor 18. The sub-flooring 16 is supported above the support base 14 in a spaced-apart relationship so as to define a floor gap 20. The sub-flooring 16 typically includes a first layer of plywood 22 and a second layer of plywood 24. The first layer of plywood 22 is often oriented in one direction while the second layer of plywood 24 is oriented in a second direction which is often 45 degrees (not shown) or 90 degrees (FIG. 1) relative to the first direction. The floor 18 is constructed of a plurality of strips of material 26 positioned on the sub-flooring 16 and cooperating to form the floor 18. The strips of material 26 are typically manufactured from maple or other suitable wood. The floor 18 includes a peripheral edge 28 positioned proximate to the wall 12 so as to provide an expansion gap 30 located at a floor-wall junction 32.

A plurality of spacers or shock absorbers 34 are illustrated supporting the sub-flooring 16 in a spaced apart relation with respect to the base 14. The shock absorbers 34 are connected to the bottom surface of the first layer of plywood 22 at an equal center-to-center distance. By way of example, U.S. Pat. No. 6,742,312, which is expressly incorporated herein by reference, discloses a type of shock absorber 34 used in conjunction with the present invention. However, it will be appreciated that any configuration of spacer or shock absorber may be used to support the sub-flooring 16.

The baseboard 19 is illustrated positioned over at least a portion of the floor 18 and the wall 12 to cover the expansion gap 30 while providing sufficient air-flow (represented by arrows 36*a* and 36*b*) to and from the floor gap 20 to prevent the accumulation of moisture on the underside of the floor 18. The baseboard 19 is a substantially L-shaped body characterized as having a toe portion 38 and a wall portion 40. The wall portion 40 includes a front side 42, a back side 44, an upper end 46, and a lower end 48. The baseboard 19 further includes an outer beveled edge 50 (FIG. 1) which provides an area of relief at the intersection of the toe portion 38 and the wall portion 40 to facilitate installation. It should be understood that the toe portion 38 may intersect the wall portion 40 at a substantially square edge, rounded edge, or any other edge configuration allowing the baseboard 19 to cover the expansion gap 30. The toe portion 38 is positioned adjacent the floor 18 and the wall portion 40 is positioned adjacent the wall 14.

Figure 4:
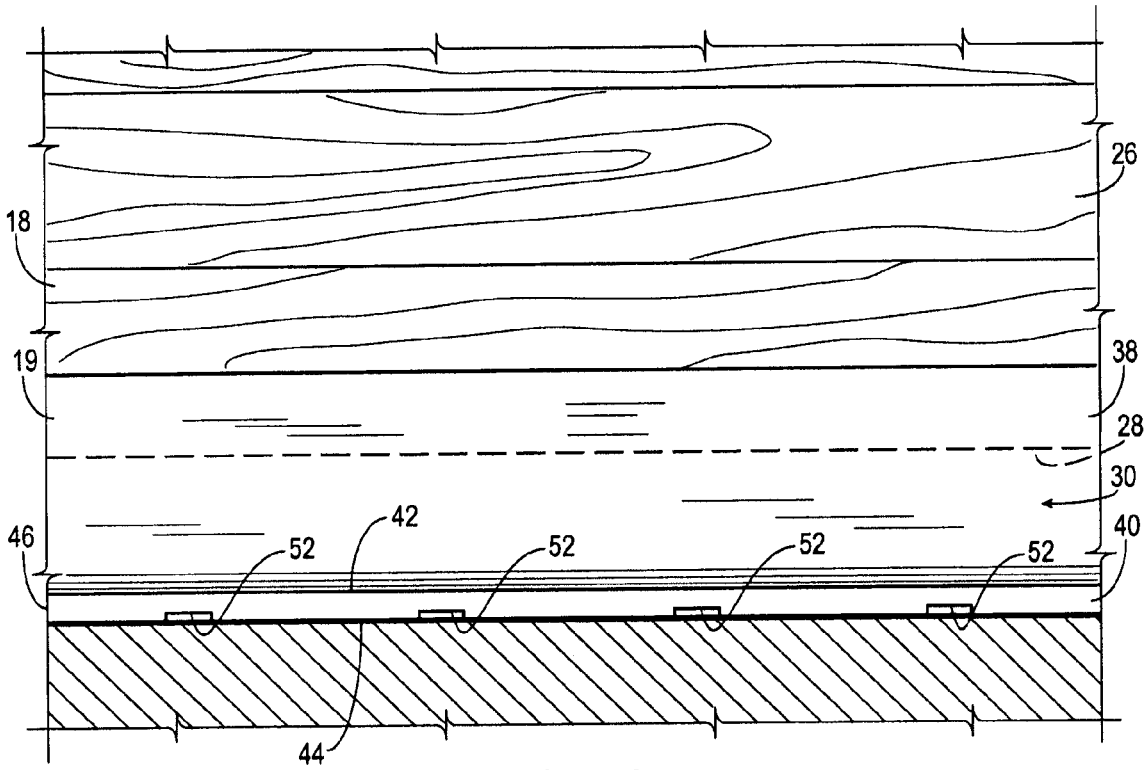
FIG. 4 is a top plan view of the baseboard shown positioned over a portion of the floor and the wall.

Shown in FIGS. 2 and 4, the back side 44 of the wall portion 40 includes a plurality of spaced-apart, ventilation channels 52 extending from the upper end 46 of the wall portion 40 to the lower end 48 thereof to permit air-flow to and from the floor gap 20. However, it will be appreciated that each ventilation channel 52 may be positioned at a variety of directions including, for example, diagonally so long as air is permitted to flow to and from the floor gap 20. Each ventilation channel 52 preferably has a substantially rectangular cross-section. By way of example, each ventilation channel 52 may have a width of ½ inch and a depth of ⅛ inch. In addition, it is preferred that a sufficient number of ventilation channels 52 be formed so that the wall portion 40 has a flow area of at least about 0.20 square inches per linear foot when the wall portion 40 is secured to the wall 12, but more preferably, a flow area of at least about 0.25 square inches per linear foot when the wall portion 40 is secured to the wall 12.

Figure 3:
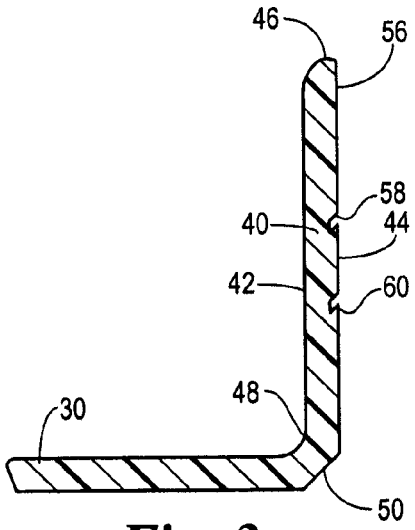
FIG. 3 is a cross-section taken along line 3-3 of FIG. 2.
Figure 3A:
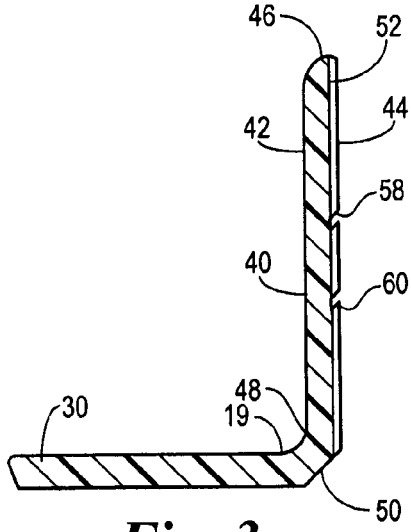

A wall contact surface 56 extends between each ventilation channel 52 for engaging the wall 12 upon the application of a suitable adhesive to the wall contact surfaces 56. Each wall contact surface 56 is substantially rectangular in shape. As a result of the increase in flow area created by the ventilation channels 52, the area of the wall contact surface 56 is reduced. To compensate for the reduction in the area of the wall contact surface 56, each wall contact surface 56 includes a plurality of adhesive gripping grooves 58 formed therethrough for receiving adhesive. Shown in FIGS. 2 and 3, each groove 58 is defined by at least one acute angled surface 59 that functions as a catch element for providing a mechanical bond to adhesive that flows into the grooves 58 upon application of the wall portion 40 to the wall 12 and thereafter hardens. Each groove 58 may extend in any direction or at any angle, however, each groove 58 is preferably extended downward at an angle of about 45 degrees. However, it will be appreciated that the plurality of grooves 58 may extend in any direction or at any angle so long as each groove 58 is capable of providing the catch element 60. The wall contact surfaces 56 further include a fine, outwardly projecting texture 62 for further enhancing the grip of the adhesive to the wall contact surfaces 56.

The baseboard 19 is formed into a one piece unit using conventional manufacturing processes, such as, injection molding and is preferably constructed of thermoplastic elastomer injected with a foaming agent to provide a durable, lightweight baseboard 19 having a tear strength of approximately 800 pounds per square inch and a weight of approximately 0.83 pounds per linear foot, whereby a case of 16 baseboards of the present invention weighs less than about 55 pounds thereby reducing shipping costs and potential injuries resulting from lifting and/or moving cases of baseboards.

During manufacturing, the material may be heated within a temperature range of about 340° F. to about 360° F., and preferably heated to a temperature of about 350° F. causing flow lines (not shown) to be created throughout the baseboard 19. The flow lines provide a marbled appearance which hides evidence of mars from a distance of up to about two feet.

From the above description it is clear that the present invention is well adapted to carry out the objects and to attain the advantages mentioned herein as well as those inherent in the invention. While a presently preferred embodiment of the invention has been described for purposes of this disclosure, it will be understood that numerous changes may be made which will readily suggest themselves to those skilled in the art and which are accomplished within the spirit of the invention disclosed and as defined in the appended claims.

What is claimed is:

1. A floor assembly in combination with a vertical wall, the floor assembly comprising:

a rigid support base;

a sub-flooring supported above the support base in a spaced-apart relationship so as to define a floor gap;

a plurality of strips of material positioned on the sub-flooring and cooperating to form a floor, the floor having a peripheral edge positioned proximate to the wall to provide an expansion gap; and a substantially L-shaped baseboard having a toe portion and a wall portion, the wall portion adhesively secured to the wall with at least a portion of the toe portion extending over a portion of the floor so that the baseboard covers the expansion gap, the wall portion having a front side, a back side, an upper end, and a lower end, the back side of the wall portion provided with a plurality of spaced-apart ventilation channels extending entirely across the wall portion from the upper end of the wall portion to the lower end thereof to permit air-flow to and from the floor gap, each ventilation channel having a substantially rectangular cross-section and providing the wall portion with a flow area of at least about 0.20 square inches per linear foot when the wall portion is secured to the wall, the back side of the wall portion further having a plurality of wall contact surfaces extending between each ventilation channel, the wall contact surfaces engaging the wall and having a plurality of adhesive holding grooves terminating between the front side and the back side of the wall portion, each groove defined by at least one acute angled surface so as to function as a catch element, the baseboard being formed of a polymeric material so as to have a weight of less than about 0.83 pounds per linear foot and so as to have a plurality of flow lines extending therethrough so as to mask evidence of marring.

2. The combination of claim 1 wherein the baseboard further includes an outer beveled edge at the intersection of the toe portion and the wall portion.

3. The combination of claim 1 wherein the plurality of grooves are angled downward toward the toe portion.

* * * * *